US006127323A

United States Patent [19]

Watts et al.

[11] Patent Number: 6,127,323

[45] Date of Patent: Oct. 3, 2000

[54] POWER TRANSMISSION FLUIDS CONTAINING ALKYL PHOSPHONATES

[75] Inventors: Raymond Frederick Watts, Long Valley; David Edward Gindelberger, Bedminster, both of N.J.

[73] Assignee: Exxon Chemical Patents Inc., Linden, N.J.

[21] Appl. No.: 08/837,639

[22] Filed: Apr. 21, 1997

[51] Int. Cl.[7] ..... C10M 141/10

[52] U.S. Cl. ..... 508/291; 508/408; 508/433; 252/78.5

[58] Field of Search ..... 508/433, 291, 508/408; 252/78.5

[56] References Cited

U.S. PATENT DOCUMENTS

| | | | |
|---|---|---|---|
| 2,963,437 | 12/1960 | Ries, Jr. | 508/433 |
| 4,105,572 | 8/1978 | Shaub et al. | 252/32.7 E |
| 4,108,889 | 8/1978 | Conner | 260/502.4 R |
| 4,116,877 | 9/1978 | Outten et al. | 252/78.5 |
| 4,158,633 | 6/1979 | Papay | 508/433 |
| 4,356,097 | 10/1982 | Papay | 508/433 |
| 5,597,506 | 1/1997 | Bloch et al. | 508/433 |
| 5,652,201 | 7/1997 | Papay et al. | 508/228 |

FOREIGN PATENT DOCUMENTS

| | | |
|---|---|---|
| 1247541 | 9/1971 | United Kingdom . |

*Primary Examiner*—Jerry D. Johnson

[57] ABSTRACT

The anti-shudder durability of power transmitting fluids, particularly automatic transmission fluids, is improved by incorporating a combination of alkyl phosphonates, ashless dispersants and metallic detergents.

9 Claims, No Drawings

POWER TRANSMISSION FLUIDS CONTAINING ALKYL PHOSPHONATES

FIELD OF THE INVENTION

This invention relates to a composition and a method of improving the anti-shudder durability of power transmitting fluids, particularly automatic transmission fluids.

BACKGROUND OF THE INVENTION

The continuing search for methods to improve overall vehicle fuel economy has identified the torque converter or fluid coupling used between the engine and automatic transmission, as a relatively significant source of energy loss. Since the torque converter is a fluid coupling, it is not as efficient as a solid disk-type clutch. At any set of operating conditions (e.g., engine speed, throttle position, ground speed, transmission gear ratio), there is a relative speed difference between the driving and driven members of the torque converter. This relative speed differential represents lost energy which is dissipated from the torque converter as heat.

One method of improving overall vehicle fuel economy used by transmission builders is to build into the torque converter a clutch mechanism capable of "locking" the torque converter. "Locking" refers to eliminating relative motion between the driving and driven members of the torque converter so that little energy is lost in the fluid coupling. These "locking" or "lock-up" clutches are very effective at capturing lost energy at high road speeds. When they are used at low speeds, however, vehicle operation becomes rough and engine vibration is transmitted through the drive train. Rough operation and engine vibration are not acceptable to drivers.

The higher the percentage of time that the vehicle can be operated with the torque converter clutch engaged, the more fuel efficient the vehicle becomes. A second generation of torque converter clutches have been developed which operate in a "slipping" or "continuously sliding mode". These devices have a number of names, but are commonly referred to as continuously slipping torque converter clutches. The difference between these devices and lock-up clutches is that they allow some relative motion between the driving and driven members of the torque converter, normally a relative speed of 10 to 200 rpm. This slow rate of slipping allows for improved vehicle performance as the slipping clutch acts as a vibration damper. Whereas the "lock-up" type clutch could only be used at road speeds above approximately 50 mph, the "slipping" type clutches can be used at speeds as low as 25 mph, thereby capturing significantly more lost energy. It is this feature that makes these devices very attractive to vehicle manufacturers.

Continuously slipping torque converter clutches impose very exacting friction requirements on automatic transmission fluids (ATF's) used with them. The fluid must have a very good friction versus velocity relationship, that is, friction must always increase with increasing speed. If friction decreases with increasing speed, then a self-exciting vibrational state can be set up in the driveline. This phenomenon is commonly called "stick-slip" or "dynamic frictional vibration" and manifests itself as "shudder" or low speed vibration in the vehicle. Clutch shudder is very objectionable to the driver. A fluid which allows the vehicle to operate without vibration or shudder is said to have good "anti-shudder" characteristics. Not only must the fluid have an excellent friction versus velocity relationship when it is new, it must retain those frictional characteristics over the lifetime of the fluid, which can be the lifetime of the transmission. The longevity of the anti-shudder performance in the vehicle is commonly referred to as "anti-shudder durability". It is this aspect of performance that this invention addresses.

What we have now found is that fluids containing long chain alkyl phosphonates and metallic detergents provide significantly improved anti-shudder durability.

SUMMARY OF THE INVENTION

This invention relates to a composition and method of improving the anti-shudder durability of a power transmitting fluid using the composition, where the composition comprises a mixture of:

(1) a major amount of a lubricating oil; and (2) an anti-shudder improving effective amount of an additive composition, the additive composition comprising:

(a) an oil-soluble alkyl phosphonate having the following structure:

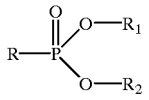

wherein: R is $C_8$ to $C_{30}$ hydrocarbyl, $R_1$ is $C_1$ to $C_{20}$ hydrocarbyl, and $R_2$ is $C_1$ to $C_4$ hydrocarbyl or hydrogen;

(b) an ashless dispersant; and (c) a metallic detergent.

DETAILED DESCRIPTION OF THE INVENTION

We have found that fluids containing the selected alkyl phosphonates not only provide excellent fresh oil friction versus velocity characteristics, but that these characteristics are retained for as much as 10 times as long as those found in conventional automatic transmission fluids. The anti-shudder durability of these fluids can be further improved by incorporating ashless dispersants and metallic detergents.

While the invention is demonstrated for a particular power transmitting fluid, that is, an ATF, it is contemplated that the benefits of this invention are equally applicable to other power transmitting fluids. Examples of other types of power transmitting fluids included within the scope of this invention are gear oils, hydraulic fluids, heavy duty hydraulic fluids, industrial oils, power steering fluids, pump oils, tractor fluids, universal tractor fluids, and the like. These power transmitting fluids can be formulated with a variety of performance additives and in a variety of base oils.

Increasing the anti-shudder durability of an ATF is a very complex problem. Although it appears that a simple solution would be to merely increase the amount of conventional friction modifier in the fluid, this is not feasible because simply increasing the concentration of conventional friction modifiers, significantly reduces the overall level of friction exhibited by the fluid. Reduction of friction coefficients below certain minimum levels is undesirable since the holding capacity, or static capacity, of all the clutches in the transmission is thereby reduced, making these clutches prone to slip during vehicle operation. Slipping of the shifting clutches must be avoided, as these clutches will be destroyed by unwanted slipping.

1. Lubricating Oils

Lubricating oils useful in this invention are derived from natural lubricating oils, synthetic lubricating oils, and mixtures thereof. In general, both the natural and synthetic lubricating oil will each have a kinematic viscosity ranging from about 1 to about 100 $mm^2/s$ (cSt) at 100° C., although typical applications will require the lubricating oil or lubricating oil mixture to have a viscosity ranging from about 2 to about 8 $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil is mineral oil.

Suitable mineral oils include all common mineral oil basestocks. This includes oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlordiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

Typically the mineral oils will have kinematic viscosities of from 2.0 $mm^2/s$ (cSt) to 8.0 $mm^2/s$ (cSt) at 100° C. The preferred mineral oils have kinematic viscosities of from 2 to 6 $mm^2/s$ (cSt), and most preferred are those mineral oils with viscosities of 3 to 5 $mm^2/s$ (cSt) at 100° C.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly (1-octenes), poly-(1-decenes), etc., and mixtures thereof]; alkylbenzenes [e.g., dodecyl-benzenes, tetradecylbenzenes, dinonyl-benzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. The preferred oils from this class of synthetic oils are oligomers of α-olefins, particularly oligomers of 1-decene.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000 to 1500); and mono- and poly-carboxylic esters thereof (e.g., the acetic acid esters, mixed $C_3$–$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils are adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetra-ethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)-siloxanes and poly (methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetra-hydrofurans, poly-α-olefins, and the like.

The lubricating oils may be derived from refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and are often additionally processed by techniques for removal of spent additives and oil breakdown products.

When the lubricating oil is a mixture of natural and synthetic lubricating oils (that is, partially synthetic), the choice of the partial synthetic oil components may widely vary, however, particularly useful combinations are comprised of mineral oils and poly-α-olefins (PAO), particularly oligomers of 1-decene.

2. Additive Composition (a). Alkyl Phosphonates

The oil-soluble alkyl phosphonates useful in the present invention are the di- and tri-alkyl phosphonates. These phosphonates have the following structure:

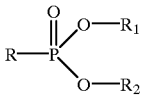

wherein: R is $C_8$ to $C_{30}$ hydrocarbyl, $R_1$ is $C_1$ to $C_{20}$ hydrocarbyl and $R_2$ is $C_1$ to $C_4$ hydrocarbyl or hydrogen.

As used in this specification and appended claims the term "hydrocarbyl" denotes a group having a carbon atom directly attached to the remainder of the molecule and having predominantly hydrocarbon character within the context of this invention. Such groups include the following: (1) Hydrocarbon groups, that is, aliphatic (e.g., alkyl or alkenyl), alicyclic (e.g., cycloalkyl of cycloalkenyl), aromatic aliphatic and alicyclic groups and the like, as well as cyclic groups wherein the ring is completed through another portion of the molecule. When R is aryl, the aryl groups consist of from 6 to 30 carbon atoms and contain at least one unsaturated "aromatic" ring structure. Such groups are known to those skilled in the art. Examples include methyl, ethyl, octyl, decyl, octadecyl, cyclohexyl and phenyl. (2) Substituted hydrocarbon groups, that is, groups containing non-hydrocarbon substituents which in the context of this invention, do not alter the predominantly hydrocarbon nature of the group. Those skilled in the art will be aware of suitable substituents. Examples include, but are not limited to, halo, hydroxy, nitro, cyano, alkoxy, and acyl. (3) Hetero groups, that is, groups which while predominantly hydrocarbon in character within the context of this invention, contain atoms of other than carbon in a chain or ring otherwise composed of carbon atoms. Suitable hetero atoms will be apparent to those skilled in the art and include, for example, nitrogen, oxygen, and sulfur. R can also vary independently. As stated, R can be alkyl, aryl, and they may be linear or branched; the aryl groups may be phenyl or substituted phenyl. The R groups may be saturated or unsaturated, and they may contain hetero atoms such as sulfur, nitrogen and oxygen.

The preferred materials are the trialkyl phosphonates where R is $C_8$ to $C_{30}$ alkyl, more preferably $C_{10}$ to $C_{24}$ alkyl, and most preferably $C_{12}$ to $C_{20}$ alkyl; and $R_1$ and $R_2$ are independently $C_1$ to $C_{20}$ alkyl, more preferably $C_1$ to $C_{10}$ alkyl, and most preferably $C_1$ to $C_4$ alkyl. In general, the R group is preferably a linear alkyl such n-decyl, n-hexadecyl, and n-octadecyl. The most preferred R groups are n-hexadecyl and n-octadecyl. $R_1$ and $R_2$ are preferably the same and either methyl or ethyl; the most preferred is $R_1=R_2=-CH_2CH_3$.

While any effective amount of the alkyl phosphonate may be used to achieve the benefits of the invention, typically these effective amounts will be from 0.1 to 10.0 mass percent in the finished fluid. Preferably the treat rate will be from 0.5% to 8.0%, and most preferably from 1.0 to 5.0%.

The alkyl phosphonates of the current invention are readily prepared by a number of convenient methods. One such method is described in U.S. Pat. No. 4,108,889 which is incorporated herein by reference to more fully describe the state of the art.

The following examples are illustrative of the preparation of the alkyl phosphonates useful with this invention. In the following examples, as well as throughout the specification, unless otherwise indicated, all parts and percentages are by weight, all temperatures are in degrees Celsius, and all pressures are at or near atmospheric pressure.

PREPARATIVE EXAMPLES

Example A-1

Into a suitable vessel equipped with a stirrer, condenser and nitrogen sparger were introduced 140 g (1.0 mol) of 1-decene and 160 g (1.16 mol) of diethyl hydrogen phosphite. With the stirrer operating and the solution sparged with nitrogen, 3 mL of di-t-butylperoxide was added. The mixture was stirred for 10 minutes at room temperature and then the temperature was raised to approximately 130° C. and held there for 2 hours. After 2 hours of heating, a small aliquot of the reaction mixture was analyzed for the presence of olefin by infrared spectroscopy. If olefin was detected, an additional milliliter of di-t-butylperoxide was added. Once the olefin was consumed, the excess diethyl hydrogen phosphite was removed under reduced pressure. The product was cooled and analyzed. The yield was 89% and the product was found to contain 10.5% phosphorus.

Example A-2

The procedure of Example A-1 was repeated except that the following materials and amounts were used: 1-dodecene, 38 g (0.226 mol) and diethyl hydrogen phosphite, 100 g (0.69 mol). Yield: 92%; 9.8% phosphorus.

Example A-3

The procedure of Example A-1 was repeated except that the following materials and amounts were used: 1-tetradecene, 44 g (0.224 mol) and diethyl hydrogen phosphite, 100 g (0.69 mol). Yield: 92%; 9.1% phosphorus.

Example A-4

The procedure of Example A-1 was repeated except that the following materials and amounts were used: 1-hexadecene, 55 g (0.245 mol) and diethyl hydrogen phosphite, 100 g (0.69 mol). Yield: 90%; 8.8% phosphorus.

Example A-5

The procedure of Example A-1 was repeated except that the following materials and amounts were used: 1-octadecene, 144 g (0.57 mol) and dimethyl hydrogen phosphite, 98.4 g (0.895 mol). Yield: 92%; 8.6% phosphorus.

Example A-6

The procedure of Example A-1 was repeated except that the following materials and amounts were used: 1-octadecene, 316 g (1.25 mol) and diethyl hydrogen phosphite, 193 g (1.40 mol). Yield: 96%; 7.0% phosphorus.

Example A-7

The procedure of Example A-1 was repeated except that the following materials and amounts were used: mixed $C_{20}$ to $C_{24}$ olefins, 70 g (0.28 mol) and diethyl hydrogen phosphite, 100 g (0.69 mol). Yield: 96%; 7.5% phosphorus.

Examples A-8 to A-13 below use α-olefins that have been isomerized to internal olefins using the following procedure. Approximately 100 g of α-olefin and 3 g of Amberlyst-15® catalyst were placed in a suitable vessel equipped with a stirrer, condenser and nitrogen sparger. After sparging the stirred mixture with nitrogen for 15 minutes at room temperature, the temperature was raised to 120° C. and held constant for approximately 2 hours. At the end of the two hour heating, the mixture was cooled and the catalyst filtered off to give essentially a quantitative yield of isomerized olefin.

Example A-8

The procedure of Example A-1 was repeated except that the following materials and amounts were used: isomerized 1-decene, 32 g (0.228 mol) and diethyl hydrogen phosphite, 100 g (0.69 mol) . Yield: 85%; 10.2% phosphorus.

Example A-9

The procedure of Example A-1 was repeated except that the following materials and amounts were used: isomerized 1-dodecene, 38 g (0.226 mol) and diethyl hydrogen phosphite, 100 g (0.69 mol). Yield: 88%; 9.6% phosphorus.

Example A-10

The procedure of Example A-1 was repeated except that the following materials and amounts were used: isomerized 1-tetradecene, 44 g (0.224 mol) and diethyl hydrogen phosphite, 100 g (0.69 mol). Yield: 90%; 9.4% phosphorus.

Example A-11

The procedure of Example A-1 was repeated except that the following materials and amounts were used: isomerized 1-hexadecene, 55 g (0.246 mol) and diethyl hydrogen phosphite, 100 g (0.69 mol). Yield: 90%; 8.0% phosphorus.

Example A-12

The procedure of Example A-1 was repeated except that the following materials and amounts were used: isomerized 1-octadecene, 62 g (0.246 mol) and diethyl hydrogen phosphite, 100 g (0.69 mol). Yield: 94%; 8.0% phosphorus.

Example A-13

The procedure of Example A-1 was repeated except that the following materials and amounts were used: isomerized mixed $C_{20}$ to $C_{24}$ α-olefins, 70 g (0.228 mol) and diethyl hydrogen phosphite, 100 g (0.69 mol). Yield: 92%; 7.8% phosphorus.

(b). Ashless Dispersant

Suitable dispersants include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Also useful are condensation products of polyamines and hydrocarbyl substituted phenyl acids. Mixtures of these dispersants can also be used.

Basic nitrogen containing ashless dispersants are well-known lubricating oil additives, and methods for their preparation are extensively described in the patent literature. For example, hydrocarbyl-substituted succinimides and succinamides and methods for their preparation are described, in U.S. Pat. Nos. 3,018,247; 3,018,250; 3,018,291; 3,361,673; and 4,234,435. Mixed ester-amides of hydrocarbyl-substituted succinic acids are described, for example, in U.S. Pat. Nos. 3,576,743; 4,234,435; and 4,873,009. Mannich dispersants, which are condensation products of hydrocarbyl-substituted phenols, formaldehyde and polyamines are described, for example, in U.S. Pat. Nos. 3,368,972; 3,413,347; 3,539,633; 3,697,574; 3,725,277; 3,725,480; 3,726,882; 3,798,247; 20 3,803,039; 3,985,802; 4,231,759; and 4,142,980. Amine dispersants and methods for their production from high molecular weight aliphatic or alicyclic halides and amines are described, for example, in U.S. Pat. Nos. 3,275,554, 3,438,757, and 3,565,804.

The preferred dispersants are the alkenyl succinimides and succinamides. The succinimide or succinamide dispersants can be formed from amines containing basic nitrogen and additionally one or more hydroxy groups. Usually, the amines are polyamines such as polyalkylene polyamines, hydroxy-substituted polyamines and polyoxyalkylene polyamines. Examples of polyalkylene polyamines include diethylene triamine, triethylene tetramine, tetraethylene pentamine, and pentaethylene hexamine. Low cost poly (ethyleneamines) (PAM's) averaging about 5 to 7 nitrogen atoms per molecule are available commercially under trade names such as Polyamine H®, Polyamine 400®, and Dow Polyamine E-100®. Hydroxy-substituted amines include N-hydroxyalkyl-alkylene polyamines such as N-(2-hydroxyethyl)ethylene diamine, N-(2-hydroxyethyl) piperazine, and N-hydroxyalkylated alkylene diamines of the type described in U.S. Pat. No. 5 4,873,009. Polyoxyalkylene polyamines typically include polyoxyethylene and polyoxypropylene diamines and triamines having average molecular weights in the range of 200 to 2500. Products of this type are sold commercially under the Jeffamine® trademark.

The amine is readily reacted with the selected hydrocarbyl-substituted dicarboxylic acid material, e.g., alkylene succinic anhydride, by heating an oil solution containing 5 to 95 wt. % of the hydrocarbyl-substituted dicarboxylic acid material at about 100° C. to 250° C., preferably at 125° C. to 175° C., generally for 1 to 10 hours, preferably, 2 to 6 hours, until the desired amount of water is removed. The heating is preferably carried out to favor formation of imides or mixtures of imides and amides, rather than amides and salts. Reaction ratios of hydrocarbyl-substituted dicarboxylic acid material to equivalents of amine as well as the other nucleophilic reactants described herein can vary considerably, depending on the reactants and type of bonds formed. Generally from 0.1 to 1.0, preferably from about 0.2 to 0.6, most preferably, 0.4 to 0.6, equivalents of dicarboxylic acid unit content (that is, substituted succinic anhydride content) is used per reactive equivalent of nucleophilic reactant, e.g., amine. For example, about 0.8 mol of a pentamine (having two primary amino groups and five reactive equivalents of nitrogen per molecule) is preferably used to convert a composition having a functionality of 1.6 derived from reaction of polyolefin and maleic anhydride into a mixture of amides and imides; that is, preferably the pentamine is used in an amount sufficient to provide about 0.4 equivalents (that is, 1.6 divided by (0.8×5) equivalents) of succinic anhydride units per reactive nitrogen equivalent of the amine.

Use of alkenyl succinimides which have been treated with a boronating agent are also suitable for use in the compositions of this invention as they are much more compatible with elastomeric seals made from such substances as fluoroelastomers and silicon-containing elastomers. Dispersants may be post-treated with many reagents known to those skilled in the art (see, e.g., U.S. Pat. Nos. 3,254,025, 3,502,677 and 4,857,214).

The preferred ashless dispersants are polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight ($M_n$) in the range of 500 to 5000 (preferably 800 to 3000, most preferably 900 to 2600).

The ashless dispersants of the invention can be used in any effective amount. However, they are typically used from about 0.1 to 10.0 mass percent in the finished lubricant, preferably from about 0.5 to 7.0 percent and most preferably from about 2.0 to about 5.0 percent.

PREPARATIVE EXAMPLES

Example D-1

Preparation of Polyisobutylene Succinic Anhydride (PIBSA)

A polyisobutenyl succinic anhydride having a succinic anhydride (SA) to polyisobutylene mole ratio (that is, a SA:PIB ratio) of 1.04 is prepared by heating a mixture of 100 parts of polyisobutylene (940 $M_n$; $M_w/M_n$=2.5) with 13 parts of maleic anhydride to a temperature of about 220° C. When the temperature reaches 120° C., the chlorine addition is begun and 10.5 parts of chlorine at a constant rate are added to the hot mixture for about 5.5 hours. The reaction mixture is heat soaked at 220° C. for about 1.5 hours and then stripped with nitrogen for about one hour. The resulting polyisobutenyl succinic anhydride has an ASTM Saponification Number of 112. The PIBSA product is 90 wt. % active ingredient (A.I.), the remainder being primarily unreacted PIB.

Preparation of Dispersant

Into a suitable vessel equipped with a stirrer and nitrogen sparger are placed 2180 g (approximately 2.1 mol) of the PIBSA produced above and 1925 g of solvent 150 neutral oil available from the Exxon Chemical Co. The mixture is stirred and heated under a nitrogen atmosphere. When the temperature reaches 149° C., 200 g (approximately 1.0 mol) of polyamine available from Dow Chemical Co. under the designation E-100 is added to the hot PIBSA solution over approximately 30 minutes. At the end of the addition, a subsurface nitrogen sparge is begun and continued for an additional 30 minutes. When this stripping operation is complete, that is, no further water is evolved, the mixture is cooled and filtered. The product contains 1.56% nitrogen.

Boration of Dispersant

One kilogram of the above-produced dispersant is placed in a suitable vessel equipped with a stirrer and nitrogen sparger. The material is heated to 163° C. under a nitrogen atmosphere and 19.8 g of boric acid are added over one hour. After all of the boric acid has been added a subsurface nitrogen sparge is begun and continued for 2 hours. After the 2 hour sparge the product is cooled and filtered to yield the borated dispersant. The product contains 1.5% nitrogen and 0.35% boron.

Example D-2

Preparation of Polyisobutylene Succinic Anhydride (PIBSA)

A polyisobutenyl succinic anhydride having a SA:PIB ratio of 1.13 is prepared by heating a mixture of 100 parts of polyisobutylene (2225 $M_n$; $M_w/M_n$=2.5) with 6.14 parts of maleic anhydride to a temperature of about 220° C. When the temperature reaches 120° C., the chlorine addition is begun and 5.07 parts of chlorine at a constant rate are added to the hot mixture for about 5.5 hours. The reaction mixture is heat soaked at 220° C. for about 1.5 hours and then stripped with nitrogen for about one hour. The resulting polyisobutenyl succinic anhydride has an ASTM Saponification Number of 48. The PIBSA product is 88 wt. % active ingredient (A.I.), the remainder being primarily unreacted PIB.

Preparation of Dispersant

Into a suitable vessel equipped with a stirrer and nitrogen sparger are placed 4090 g (approximately 1.75 mol) of the PIBSA produced above and 3270 g of solvent 150 neutral oil available from the Exxon Chemical Co. The mixture is stirred and heated under a nitrogen atmosphere. When the temperature reaches 149° C. 200 g (approximately 1.0 mol) of polyamine available from Dow Chemical Co. under the designation E-100 is added to the hot PIBSA solution over approximately 30 minutes. At the end of the addition, a subsurface nitrogen sparge is begun and continued for an additional 30 minutes. When this stripping operation is complete, that is, no further water is evolved, the mixture is cooled and filtered. The product contains 0.90% nitrogen.

Boration of Dispersant

One kilogram of the above produced dispersant is placed in a suitable vessel equipped with a stirrer and nitrogen sparger. The material is heated to 163° C. under a nitrogen atmosphere and 13.0 g of boric acid are added over one hour. After all of the boric acid has been added, a subsurface nitrogen sparge is begun and continued for 2 hours. After the 2 hour sparge, the product is cooled and filtered to yield the borated dispersant. The product contains 0.88% nitrogen and 0.23% boron.

Use of alkenyl succinimides which have been treated with an inorganic acid of phosphorus or an anhydride thereof and a boronating agent are also suitable for use in the compositions of this invention as they are much more compatible with elastomeric seals made from such substances as fluoroelastomers and silicon-containing elastomers. Polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight ($M_n$) in the range of 500 to 5000 (preferably 800 to 2500) are particularly suitable. Dispersants may be post-treated with many reagents known to those skilled in the art. (see, e.g., U.S. Pat. Nos. 3,254,025; 3,502,677; and 4,857,214).

In order to produce a homogeneous product, it may be desirable to pre-mix or pre-contact at elevated temperatures the dispersant with the alkyl phosphonates. optionally, other additives which do not interfere with producing the homogeneous product are included. Typical elevated temperatures range from 60° C. to 200° C., preferably from 75° C. to 175° C., and most preferably from 100° C. to 150° C.

(c). Metallic Detergents

The metal-containing detergents of the compositions of this invention are exemplified by oil-soluble neutral or overbased salts of alkali or alkaline earth metals with one or more of the following acidic substances (or mixtures thereof): (1) sulfonic acids, (2) carboxylic acids, (3) salicylic acids, (4) alkyl phenols, (5) sulfurized alkyl phenols, and (6) organic phosphorus acids characterized by at least one direct carbon-to-phosphorus linkage. Such organic phosphorus acids include those prepared by the treatment of an olefin polymer (e.g., polyisobutylene having a molecular weight of 1,000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The preferred salts of such acids from the cost-effectiveness, toxicological, and environmental standpoints are the salts of sodium, potassium, lithium, calcium and magnesium. The preferred salts useful with this invention are either neutral or overbased salts of calcium or magnesium. The most preferred salts are calcium sulfonate, calcium phenate, magnesium sulfonate, and magnesium phenate.

Oil-soluble neutral metal-containing detergents are those detergents that contain stoichiometrically equivalent amounts of metal in relation to the amount of acidic moieties present in the detergent. Thus, in general the neutral detergents will have a low basicity when compared to their overbased counterparts. The acidic materials utilized in forming such detergents include carboxylic acids, salicylic acids, alkylphenols, sulfonic acids, sulfurized alkylphenols and the like.

The term "overbased" in connection with metallic detergents is used to designate metal salts wherein the metal is present in stoichiometrically larger amounts than the organic radical. The commonly employed methods for preparing the overbased salts involve heating a mineral oil solution of an acid with a stoichiometric excess of a metal neutralizing agent such as the metal oxide, hydroxide, carbonate, bicarbonate, or sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkyl phenol, thiophenol, sulfurized alkylphenol, and condensation products of formaldehyde with a phenolic substance; alcohols such as methanol, 2-propanol, octanol, Cellosolve® alcohol, Carbitol® alcohol, ethylene glycol, stearyl alcohol, and cyclohexyl alcohol; and amines such as aniline, phenylene diamine, phenothiazine, phenyl-β-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60° C. to 200° C.

Examples of suitable metal-containing detergents include, but are not limited to, neutral and overbased salts of such substances as lithium phenates, sodium phenates, potassium phenates, calcium phenates, magnesium phenates, sulfurized lithium phenates, sulfurized sodium phenates, sulfurized potassium phenates, sulfurized calcium phenates, and sulfurized magnesium phenates, wherein each aromatic group has one or more aliphatic groups to impart hydrocarbon solubility; lithium sulfonates, sodium sulfonates, potassium sulfonates, calcium sulfonates, and magnesium sulfonates, wherein each sulfonic acid moiety is attached to an aromatic nucleus which in turn usually contains one or more aliphatic substituents to impart hydrocarbon solubility; lithium salicylates, sodium salicylates, potassium salicylates, calcium salicylates and magnesium salicylates wherein the aromatic moiety is usually substituted by one or more aliphatic substituents to impart hydrocarbon solubility; the lithium, sodium, potassium, calcium and magnesium salts of hydrolyzed phosphosulfurized olefins having 10 to 2,000 carbon atoms or of hydrolyzed phosphosulfurized alcohols and/or aliphatic-substituted phenolic compounds having 10 to 2,000 carbon atoms; lithium, sodium, potassium, calcium and magnesium salts of aliphatic carboxylic acids and aliphatic substituted cycloaliphatic carboxylic acids; and many other similar alkali and alkaline earth metal salts of oil-soluble organic acids. Mixtures of neutral or overbased salts of two or more different alkali and/or alkaline earth metals can be used. Likewise, neutral and/or overbased salts of mixtures of two or more different acids (e.g., one or more overbased calcium phenates with one or more overbased calcium sulfonates) can also be used.

As is well known, overbased metal detergents are generally regarded as containing overbasing quantities of inorganic bases, probably in the form of micro dispersions or colloidal suspensions. Thus the term "oil-soluble" as applied to metallic detergents is intended to include metal detergents wherein inorganic bases are present that are not necessarily completely or truly oil-soluble in the strict sense of the term, inasmuch as such detergents when mixed into base oils behave much the same way as if they were fully and totally dissolved in the oil.

Collectively, the various metallic detergents referred to herein above, are sometimes called neutral, basic or overbased alkali metal or alkaline earth metal-containing organic acid salts.

Methods for the production of oil-soluble neutral and overbased metallic detergents and alkaline earth metal-containing detergents are well known to those skilled in the art, and extensively reported in the patent literature. See, for example, U.S. Pat. Nos. 2,001,108; 2,081,075; 2,095,538; 2,144,078; 2,163,622; 2,270,183; 2,292,205; 2,335,017; 2,399,877; 2,416,281; 2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 3,907,691; 4,100,085; 4,129,589; 4,137,184; 4,184,740; 4,212,752; 4,617,135; 4,647,387; and 4,880,550.

The metallic detergents utilized in this invention can, if desired, be oil-soluble boronated neutral and/or overbased alkali of alkaline earth metal-containing detergents. Methods for preparing boronated metallic detergents are described in, for example, U.S. Pat. Nos. 3,480,548; 3,679,584; 3,829,381; 3,909,691; 4,965,003; and 4,965,004.

Preferred metallic detergents for use with this invention are overbased sulfurized calcium phenates, overbased calcium sulfonates, and overbased magnesium sulfonates.

While any effective amount of the metallic detergents may be used to enhance the benefits of this invention, typically these effective amounts will range from 0.01 to 2.0, preferably from 0.05 to 1.0, and most preferably from 0.05 to 0.5 weight percent in the finished fluid.

Other additives known in the art may be added to the power transmitting fluids of this invention. These additives include dispersants, antiwear agents, corrosion inhibitors, detergents, extreme pressure additives, and the like. They are typically disclosed in, for example, "Lubricant Additives" by C. V. Smalheer and R. Kennedy Smith, 1967, pp. 1–11 and U.S. Pat. No. 4,105,571.

Representative amounts of these additives in an ATF are summarized as follows:

| Additive | Broad Wt. % | Preferred Wt. % |
|---|---|---|
| VI Improvers | 1–12 | 1–4 |
| Corrosion Inhibitor | 0.01–3 | 0.02–1 |
| Dispersants | 0.10–10 | 2–5 |
| Antifoaming Agents | 0.001–5 | 0.001–0.5 |
| Detergents | 0.01–6 | 0.01–3 |
| Antiwear Agents | 0.001–5 | 0.2–3 |
| Pour Point Depressants | 0.01–2 | 0.01–1.5 |
| Seal Swellants | 0.1–8 | 0.5–5 |
| Lubricating Oil | Balance | Balance |

The additive combinations of this invention may be combined with other desired lubricating oil additives to form a concentrate. Typically the active ingredient (a.i.) level of the concentrate will range from 20 to 90, preferably from 25 to 80, and most preferably from 35 to 75 weight percent of the concentrate. The balance of the concentrate is a diluent typically comprised of a lubricating oil or solvent.

The following examples are given as specific illustrations of the claimed invention. As with other examples provided herein, it should be understood, however, that the invention is not limited to the specific details set forth in the examples. All parts and percentages are by weight unless otherwise specified.

TESTS OF AUTOMATIC TRANSMISSION FLUID EXAMPLES

No standardized test exists for evaluating anti-shudder durability of automatic transmission fluids. Several test methods have been discussed in published literature. The methods all share a common theme, that is, continuously sliding a friction disk, immersed in a test fluid, at a certain set of conditions. At preset intervals the friction versus velocity characteristics of the fluid are determined. The common failing criteria for these tests is when dMu/dV (the change in friction coefficient with velocity) becomes negative, that is, when increasing velocity results in lower friction coefficient. A similar method which is described below, has been used to evaluate the compositions of this invention.

Anti-Shudder Durability Test Method

An SAE No. 2 test machine fitted with a standard test head was modified to allow test fluid to be circulated from an external constant temperature reservoir to the test head and back. The test head is prepared by inserting a friction disk and two steel separator plates representative of the sliding torque converter clutch (this assembly is referred to as the clutch pack). Two liters of test fluid are placed in the heated bath along with a 32 $cm^2$ (5 $in.^2$) copper coupon. A small pump circulates the test fluid from the reservoir to the test head in a loop. The fluid in the reservoir is heated to 145° C. while being circulated through the test head, and 50 mL/min of air are supplied to the test head. The SAE No. 2 machine drive system is started and the test plate rotated at 180 rpm, with no applied pressure on the clutch pack. This break-in period is continued for one hour. At the end of one hour, five (5) friction coefficient (Mu) versus velocity measurements are made. Then 6 dynamic engagements of 13,500 joules each are run, followed by one measurement of static breakaway friction. Once this data collection is accomplished a durability cycle is begun.

The durability cycle is run in approximately one hour segments. Each hour the system is "slipped" at 155° C., 180 rpm, and 10 $kg/cm^2$ for 50 minutes. At the end of the 50 minutes of slipping, twenty (20) 13,500 joule dynamic engagements are run. This procedure is repeated three more times, giving a four hour durability cycle. At the end of four hours, 5 Mu versus velocity measurements are made at 120° C. The dMu/dV for the fluid is calculated by averaging the 3rd, 4th, and 5th Mu versus velocity measurements and calculating dMu/dV by subtracting the Mu value at 0.35 m/s from the Mu value at 1.2 m/s and dividing by the speed difference, 0.85 m/s. For convenience, the number is multiplied by 1000 to convert it to a whole number. A fluid is considered to have lost anti-shudder protection when the dMu/dV reaches a value of negative three (−3). The result is reported as "Hours to Fail". Several commercial ATF's which do not possess anti-shudder durability characteristics have been evaluated by this test method. They give "Hours to Fail" in the range of 15 to 25.

anti-oxidants, corrosion inhibitor, viscosity modifier and base oil. The formulations represented typical automatic transmission fluid viscometrics.

The data in Table 1 show the effect of some of the formulation variables of the present invention. Tests 1 and 4 are representative of the claimed invention and show the effect of the length of the alkyl chain of the phosphonate, that is, the length of the alkyl group R. The formulation containing the longer R grouping, with 18 carbon atoms performs better than the one employing the shorter, 10 carbon atom, side chain, but both formulations give extended anti-shudder durability. Test 2 was identical to Test 4 except that the ashless dispersant was omitted from the formulation. The impact of this was significantly reduce anti-shudder durability, 49 hours versus greater than 200 hours. Test 3 was run on a formulation identical to Test 4 except that the metallic detergent was omitted. Failure to include the metallic detergent produced a fluid with no measurable anti-shudder durability.

It is clear from the data of Table 1 that the three components of the present invention, the oil-soluble phosphonate, the ashless dispersant, and the metallic detergent, are necessary to obtain fluids of improved anti-shudder durability.

The principles, preferred embodiments, and modes of operation of the present invention have been described in the foregoing specification. The invention which is intended to be protected herein, however, is not to be construed as limited to the particular forms disclosed, since these are to be regarded as illustrative rather than instructive. Variations and changes may be made by those skilled in the art without departing from the spirit of the invention and are intended to be embraced in the accompanying claims.

What is claimed is:

1. A method of improving the anti-shudder durability of an automatic transmission fluid comprising a major amount of lubricating oil, an ashless dispersant and overbased calcium sulfonate detergent, comprising adding to said fluid an amount sufficient to improve the anti-shudder durability of said fluid of a phosphonate of the formula

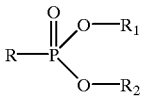

wherein: R is $C_8$ to $C_{30}$ hydrocarbyl, $R^1$ is $C_1$ to $C_{20}$ hydrocarbyl and $R^2$ is $C_1$ to $C_4$ hydrocarbyl or hydrogen.

TABLE 1

| | Phosphonate | | | | | Ashless Dispersant | | |
|---|---|---|---|---|---|---|---|---|
| Test Number | Product of Example | Carbon Number (R) | Dosage* | Metallic Detergent Type | Metallic Detergent Dosage | Product of Example | Dosage | Hours to Fail |
| 1 | A-1 | 10 | 2.5 | Ca Sulfonate** | 0.1 | D-1 | 3.25 | 110 |
| 2 | A-6 | 18 | 2.5 | Ca Sulfonate | 0.1 | — | 0 | 49 |
| 3 | A-6 | 18 | 2.5 | — | 0 | D-1 | 3.25 | 0 |
| 4 | A-6 | 18 | 2.5 | Ca Sulfonate | 0.1 | D-1 | 3.25 | >200 |

*Dosage is mass percent of finished test formulation.
**300 TBN calcium sulfonate available as Parabar 9330 from Exxon Chemical Co.

Examples Provided in Table 1

The test formulations shown in Table 1 were blended and evaluated for anti-shudder durability in the previously described test method. All formulations contained the same

2. The method of claim 1 wherein the lubricating oil is selected from the group consisting of a mineral oil, a poly-a-olefin, or mixtures thereof.

3. The method of claim 1 wherein the lubricating oil contains a synthetic base oil.

4. The method of claim 1 wherein the R group of the phosphonate is an octadecyl group.

5. The method of claim 1 wherein the amount of the phosphonate is from about 0.1 to about 10.0 mass percent of the fluid.

6. The method of claim 1 where the ashless dispersant is produced from an α-olefin polymer or copolymer and contains succinimide or amide functionality.

7. The method of claim 1 wherein the amount of the ashless dispersant is from about 0.1 to about 10.0 mass percent of the fluid.

8. The method of claim 1 wherein the amount of the overbased calcium sulfonate is from about 0.01 to about 2.0 mass percent of the automatic transmission fluid.

9. The method of claim 1 further comprising at least one of an aromatic amine-containing and a hindered phenol-containing antioxidant.

* * * * *